US012084246B2

(12) United States Patent
Murphy

(10) Patent No.: US 12,084,246 B2
(45) Date of Patent: Sep. 10, 2024

(54) DOUBLE SEALED PACKAGING AND METHOD OF MANUFACTURING THE SAME

(71) Applicant: Goodness Gardens, Inc., Warwick, NY (US)

(72) Inventor: Brian Murphy, New Hampton, NY (US)

(73) Assignee: GOODNESS GARDENS, INC., New Hampton, NY (US)

( * ) Notice: Subject to any disclaimer, the term of this patent is extended or adjusted under 35 U.S.C. 154(b) by 0 days.

(21) Appl. No.: 17/643,937

(22) Filed: Dec. 13, 2021

(65) Prior Publication Data

US 2022/0185564 A1 Jun. 16, 2022

Related U.S. Application Data

(60) Provisional application No. 63/199,165, filed on Dec. 11, 2020.

(51) Int. Cl.

| | |
|---|---|
| ***B65D 75/32*** | (2006.01) |
| ***B65D 75/58*** | (2006.01) |
| ***B65D 85/50*** | (2006.01) |

(52) U.S. Cl.

CPC ..... *B65D 75/326* (2013.01); *B65D 75/5855* (2013.01); *B65D 85/50* (2013.01); *B65D 2575/586* (2013.01)

(58) Field of Classification Search

CPC ..... B65D 77/2096; B65D 77/206; B65D 2577/2091; B65D 2577/2096; B65D 2577/2066; B65D 25/38; B65D 51/185; B65D 85/50; B65D 75/5894; B65D 2251/0031; B65D 2251/0093

USPC ..... 220/257.2

See application file for complete search history.

(56) References Cited

U.S. PATENT DOCUMENTS

| | | | | |
|---|---|---|---|---|
| 6,964,145 | B1 * | 11/2005 | O'Gallcobhair | B65B 9/042 53/133.1 |
| 7,740,730 | B2 | 6/2010 | Schedl et al. | |
| 2004/0118852 | A1 * | 6/2004 | Barmore | B65D 77/2044 220/359.3 |
| 2010/0172604 | A1 * | 7/2010 | Andersson | B65D 75/5838 383/211 |
| 2016/0122109 | A1 * | 5/2016 | Clark | B65D 75/5888 220/23.4 |
| 2017/0073136 | A1 * | 3/2017 | Konicke | B65D 77/2096 |
| 2022/0289451 | A1 * | 9/2022 | Bucher | B65D 85/54 |

FOREIGN PATENT DOCUMENTS

| | | | |
|---|---|---|---|
| DE | 102007035501 | A1 | 8/2008 |
| DE | 102018206323 | A1 | 10/2019 |
| EP | 1278630 | B1 | 11/2003 |
| EP | 1577226 | B1 | 9/2005 |

(Continued)

*Primary Examiner* — Mollie Impink

(74) *Attorney, Agent, or Firm* — GOTTLIEB, RACKMAN & REISMAN, P.C.; Jason R. Wachter

(57) ABSTRACT

A packaging apparatus and a method of manufacturing the same for food products that includes a container base and two layers of material including a first layer of material and a second layer of material, with the food product arrangeable in a container base through an opening in the first layer and sealed within the container base by the second layer, which extends over the first layer.

12 Claims, 6 Drawing Sheets

(56) References Cited

FOREIGN PATENT DOCUMENTS

| | | | | |
|---|---|---|---|---|
| FR | 2734243 | B1 | 11/1996 | |
| GB | 2353986 | A | 3/2001 | |
| JP | 2911474 | B2 | 11/1990 | |
| JP | H10236494 | A | 9/1998 | |
| JP | 2002255224 | A | 9/2002 | |
| JP | 5074243 | B2 | 9/2004 | |
| JP | 2005289423 | A | 10/2005 | |
| JP | 4750502 | B2 | 2/2007 | |
| JP | 4915832 | B2 | 3/2007 | |
| JP | 2007320581 | A | 12/2007 | |
| JP | 5369660 | B2 | 7/2010 | |
| JP | 2014169102 | A | 9/2014 | |
| JP | 2015101359 | A | 6/2015 | |
| WO | WO-2012028849 | A1 * | 3/2012 | ..... B65D 47/106 |

* cited by examiner

DOUBLE SEALED PACKAGING AND METHOD OF MANUFACTURING THE SAME

CROSS-REFERENCE TO RELATED APPLICATION

This patent application claims priority to U.S. Provisional Patent Application No. 63/199,165, filed Dec. 11, 2020, which is hereby incorporated by reference in its entirety as part of the present disclosure.

FIELD OF THE INVENTION

The present disclosure generally relates to packaging and more specifically to packaging for food products (e.g., leafy greens such as herbs) that includes two layers of material with the food product arrangeable in a container base through an opening in one of the layers and sealed within the container base by the other layer. The packaging automates packing of the food product and can aid in extending the longevity/freshness of the food product.

BACKGROUND OF THE INVENTION

Several known designs of packaging for food products exist. These include, for example, a clamshell design with a living hinge connecting a bottom portion and a top portion with the top and bottom portions interacting to releaseably seal the container. Another known container includes a covering that is independent of a container base and that interacts with the container base such that the cover is releaseably fixed to the container base. Yet another design includes a single layer of material such as plastic film that is adhered to a container base to seal the container base from an outside environment.

SUMMARY OF THE INVENTION

The present invention is directed broadly to a packaging apparatus for a food product such as leafy greens (e.g., herbs) that seal the food product therein. The packaging apparatus includes a container base (e.g., plastic tray), a first layer of material that includes an opening that is fixed to the container base and a second layer of material that is arranged over the first layer of material and resealably fixed thereto.

The container base can include a bottom wall, a sidewall extending from the bottom wall to define depth within the container base and a flange, to which the first layer of material can be fixed by at least one of an adhesive and heating, extending from the sidewall.

The opening in the first layer of material can extend linearly and can be spaced from an outer periphery of the first layer of material. Alternatively, the opening in the first layer of material can be ovoid and spaced from an outer periphery of the first layer of material. The second layer of material can be a same size as the first layer of material such that the first layer of material and the second layer of material extending a same distance in all directions. The opening can be created in the first layer of material either before or after the first layer of material is adhered to the base. The second layer of material can include a perforated panel thereof that is releasably removable from and resealable to the container apparatus.

In an embodiment, the present disclosure is directed to a method of creating a packaging apparatus, comprising the following steps: forming a container base; arranging a first layer of material over the container base; fixing the first layer of material to the container base; and arranging a second layer of material over the container base and the first layer of material and at least in part, releasably fixing the second layer of material to the first layer of material.

In an embodiment, the first layer of material and the second layer of material can each be a thin layer of plastic film that can, for example, be clear, opaque or the like.

The packaging apparatus can be manufactured using a thermoforming line where the container base (plastic tray) is first formed on a thermoforming machine. Once the container tray is formed, the first layer of material can be adhered to the top of the tray. The tray can then be filled with a food product, such as leafy greens, through the opening in the first layer of material.

By adhering the first layer of material to the container base prior to filling the container base, the filling/packing of foods products (e.g., live or fresh cut plants or leafy greens such as herbs) within the container base is fully contained therein and the food product does not extend or hang out of the packaging. That is, by adhering the first layer to the container prior to packing the container with a food product, the possibility of the food product extending out of the container base, becoming trapped between a covering of the container and the base and/or prohibiting a proper seal between the container base and a sealing layer is eliminated.

After the container is filled with the food product, a second layer of material is arranged over the first layer of material and adhered to an outer periphery of the first layer of material and indirectly to an outer periphery of the container base to completely seal the packaging apparatus and food therein. The air inside the packaging apparatus can be replaced with gas, such as nitrogen, (gas flushed) to help preserve the fresh product and create a longer shelf life to be sold for retail or wholesale.

The layers of material can be adhered to the container base and/or each other by heat sealing or an adhesive. The second layer of material can be configured to be a tamper evident seal that can, for example, have perforations.

The first layer of material further aids to retain a moisture level in the package so that the food product will not lose water and become dehydrated, for example, in the case of a leafy vegetable that is stored, for example, in a refrigerator should the second layer be removed or not resealed properly to the first layer. In addition, the first layer and associated opening aid to create a "portioning opening" through which a user can remove a desired amount of the food product from the container without having to fully open the container by removing a covering therefrom to remove the food product.

DETAILED DESCRIPTION OF EMBODIMENTS OF THE PRESENT INVENTION

With reference now to the figures and in particular FIGS. 1-25, embodiments of a packaging apparatus of the present disclosure will be described.

Figure 1:
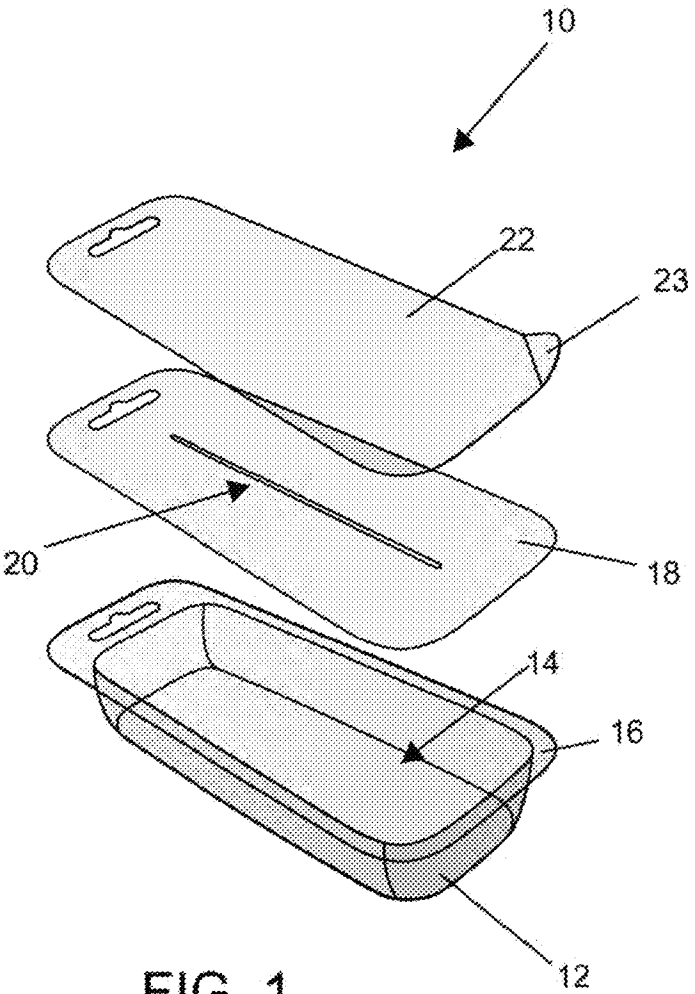
FIG. 1 is a perspective assembly view of a packaging apparatus according to an embodiment of the present disclosure.
Figure 2:
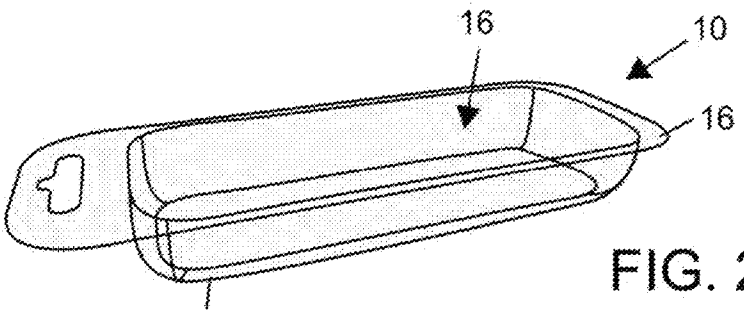
FIG. 2 is a perspective view of a container base of the packaging apparatus of FIG. 1 according to an embodiment of the present disclosure.

FIG. 1 illustrates an assembly view of a packaging apparatus 10. The packaging apparatus 10 broadly includes a container base (e.g., plastic tray) 12, a first layer of material 18 and a second layer of material 22.

The container base 12 includes a cavity therein 14 and a flange or a rim 16 that extends from the container base 12. The first layer of material 18, which is arranged over the base 12, includes an opening 20. The second layer of material 22, which is arranged over the first layer of material 18, includes a tab 23 to aid in separating the second layer of material 22 from the first layer of material 18.

In an embodiment, the first layer of material 18 and the second layer of material 22 can each be a thin layer of clear plastic film. Alternatively, the first and/or the second layers of material 18, 22, can be opaque or the like.

The packaging apparatus 10 can be manufactured using a thermoforming line where the container base 12 (see FIG. 2) is first formed on a thermoforming machine.

Figure 3:
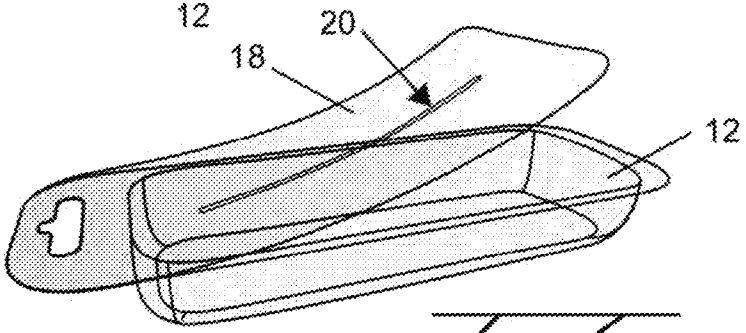
FIG. 3 is a perspective view of a first layer of material that includes an opening that extends therethrough being arranged over a container base of the packaging apparatus of FIG. 1 according to an embodiment of the present disclosure.
Figure 3:
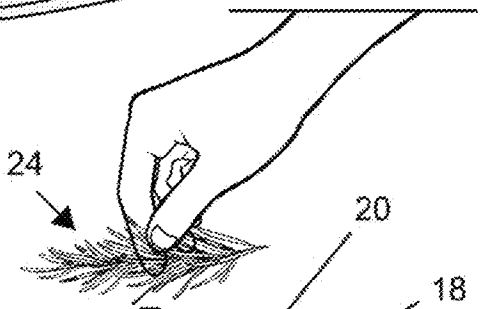

As can be seen in FIG. 3, once the container base 12 is formed, the first layer of material 18 is adhered to the flange or rim 16 of the container base 12. The opening 20, for example a slit, can be formed in the first layer of material 18 using a sharp object, such as a knife. However, it is noted that the opening 20 can be any desired size or shape and the opening 20 can be formed either before or after fixing the first layer 18 to the container base 12. For example, in another embodiment, as will be described further below and as depicted in FIGS. 10-17, an opening 120 in a first layer of material 108 is ovoid.

Figure 4:
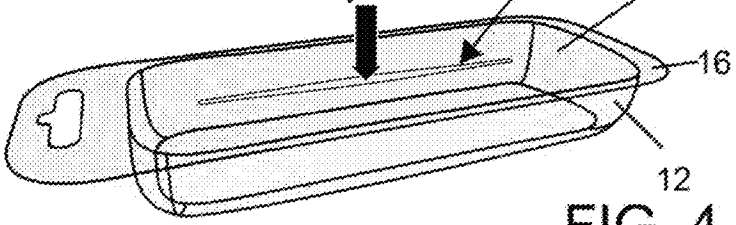
FIG. 4 is a perspective view of herbs being added through the opening in the first layer of material the packaging apparatus of FIG. 1 according to an embodiment of the present disclosure.
Figure 5:
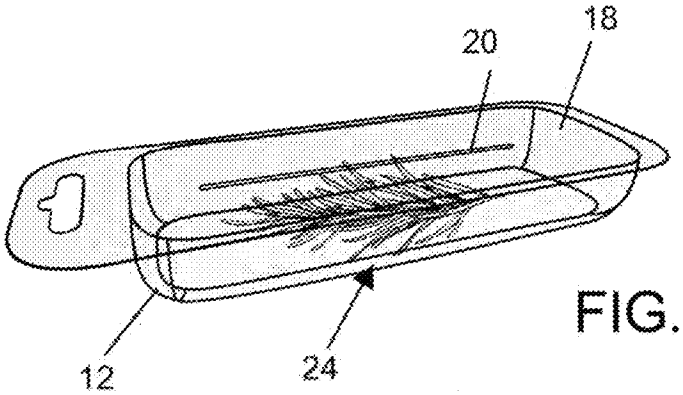
FIG. 5 is a perspective view of the placement of the herbs in the tray of the packaging apparatus of FIG. 1 according to an embodiment of the present disclosure.

Once the first layer of material 18 is fixed to the container base 12, as depicted in FIG. 4, the packaging apparatus 10 can then be filled or packed with a food product, such as leafy greens, through the opening 20 in the first layer of material 18. As shown in FIG. 5, by adhering the first layer of material 18 to the container base 12 prior to filling/packing the container base 12, the foods product (e.g., live or fresh cut plants or leafy greens such as herbs) the food product is fully contained within the container base 12 and the food product does not extend or hang out of the packaging 10. That is, by adhering the first layer 18 to the container base 12 prior to packing the container base 12 with a food product, the possibility of the food product extending out of the container base 12, becoming trapped between a covering 18, 22 of the container apparatus 10 and the base 12 and/or prohibiting a proper seal between the container base 12 and a sealing layer 18, 22 is eliminated.

Figure 6:
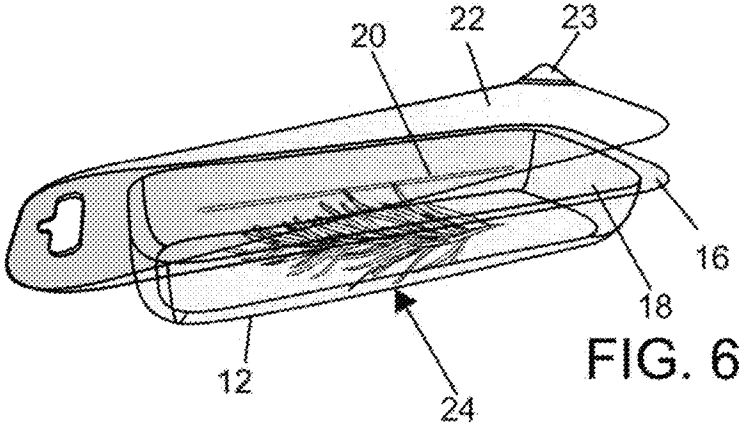
FIG. 6 is a perspective view of a second layer of material being placed over the first layer of material of the packaging apparatus of FIG. 1 according to an embodiment of the present disclosure.
Figure 7:
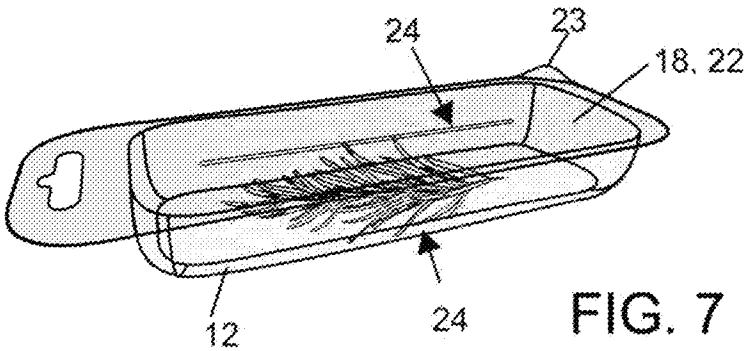
FIG. 7 is a perspective view of the second layer of material releasably fixed over the first layer of material to seal the packaging apparatus of FIG. 1 according to an embodiment of the present disclosure.

After the packaging 10 is filled with the food product, as illustrated in FIGS. 6 and 7, the second layer of material 22 is arranged over the first layer of material 18 and adhered to the outer periphery of the first layer of material 18 and indirectly to the flange 16 of the container base 12 to completely seal the packaging apparatus 10 and food therein. The air inside the packaging 10 can be replaced, for example, with nitrogen gas (gas flushed) to help preserve the fresh product and create a longer shelf life to be sold for retail or wholesale as well as stops bacteria, fungus and yeasts from growing in the package.

The layers of material 18, 22 can be adhered to the container base 12 and/or each other by heat sealing or an adhesive with the second layer 22 configured to be a tamper evident seal to protect the product inside from contamination.

Figure 8:
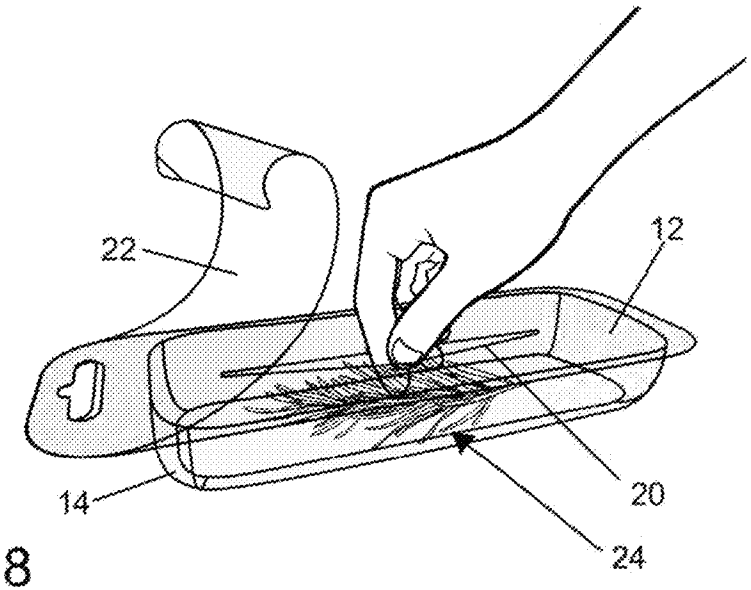
FIG. 8 is a perspective view of an individual grasping a food product (e.g., herbs) through the opening in the first layer of material after the second layer of material was peeled away from the first layer of material to allow access to the opening and in turn the food product arranged in the packaging apparatus of FIG. 1 according to an embodiment of the present disclosure.
Figure 9:
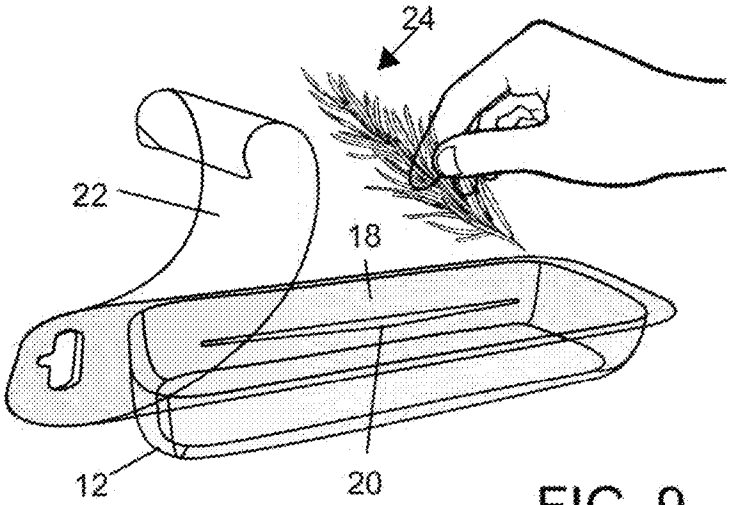
FIG. 9 is a perspective view of an individual removing the food product from the container apparatus of FIG. 1 through the opening in the first layer of material after the second layer of material is peeled away from the first layer of material to allow access to the opening and in turn the food product arranged in the packaging apparatus according to an embodiment of the present disclosure.

The first layer of material 18 can further aid to retain a moisture level in the packaging 10 so that the food product will not lose water and become dehydrated, for example, in the case of a leafy vegetable that is stored, for example, in a refrigerator should the second layer 22 be removed or not resealed properly to the first layer 18. Additionally, the first layer 18 and associated opening 20 aids to create a "portioning opening" through which an individual, as shown in FIGS. 8 and 9, can remove a desired amount of the food product from the packaging 10 without having to fully open the packaging 10 by removing a covering therefrom to remove the food product. Here, an individual can remove the food product from the packaging 10 by peeling the second layer of material 22 back and reaching into the container base 12 through the opening 20 in the first layer of material 18.

Another embodiment of a packaging apparatus 100 is depicted in FIGS. 10-17. It is noted that like reference numerals as described above and illustrated in FIGS. 1-9 will be used in conjunction with this embodiment, where applicable.

As shown in FIGS. 10-17, the packaging apparatus 100 includes the container base or tray 12, a first layer of material 108 that includes an opening 120 and the second layer of material 22. The first layer of material 108 and the second layer of material 22 can each be a thin layer of clear plastic film. Alternatively, the first and/or the second layer of material 108, 22, can be opaque or the like.

The opening 120 of the first layer of material 108 is depicted in FIGS. 10-17 as being ovoid. However, as noted above, the opening 120 can be of any shape desired. The opening 120 can be formed before or after the first layer of material 108 is fixed to the container base 12. For example, the opening 120 formed in the first layer of material 108 can be created by die cutting.

Figure 11:
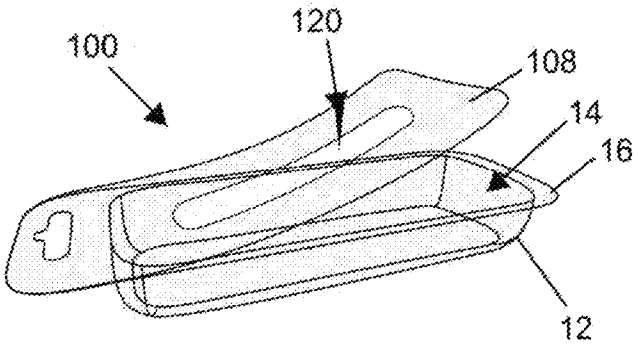
FIG. 11 is a perspective view of a first layer of material that includes an opening that extends therethrough being arranged over a container base of the packaging apparatus of FIG. 10 according to an embodiment of the present disclosure.
Figure 12:
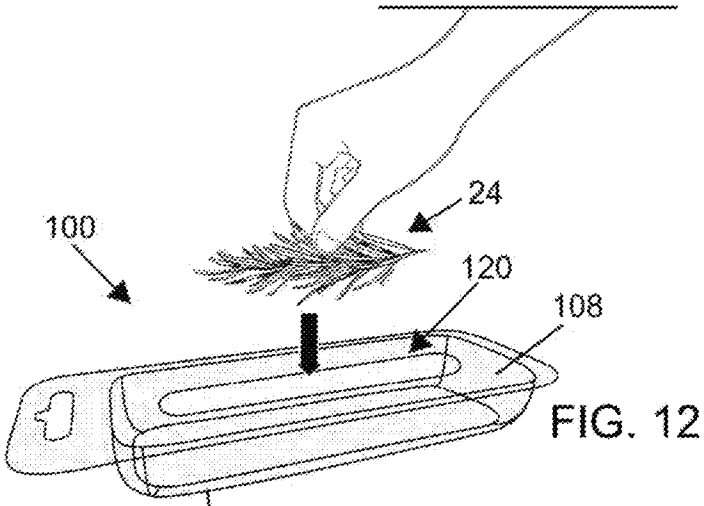
FIG. 12 is a perspective view of herbs being added through the opening in the first layer of material the packaging apparatus of FIG. 10 according to an embodiment of the present disclosure.

As can be seen in FIG. 11, the first layer of material 108 can be adhered, for example, to the rim or flange 16 of the container base 12. The container base 12, as depicted in FIG. 12, can then be filled with a food product 24, such as leafy greens, through the opening 108 in the first layer of material 108.

Figure 13:
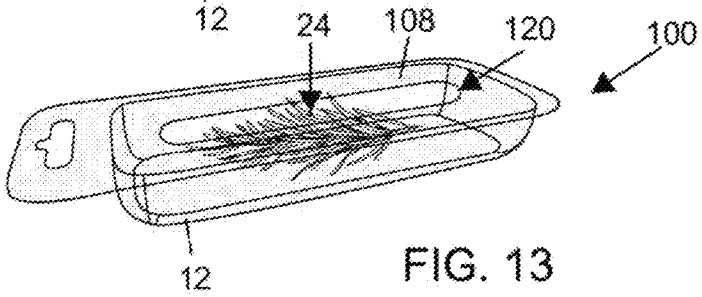
FIG. 13 is a perspective view of the placement of the herbs in the tray of the packaging apparatus of FIG. 10 according to an embodiment of the present disclosure.
Figure 24:
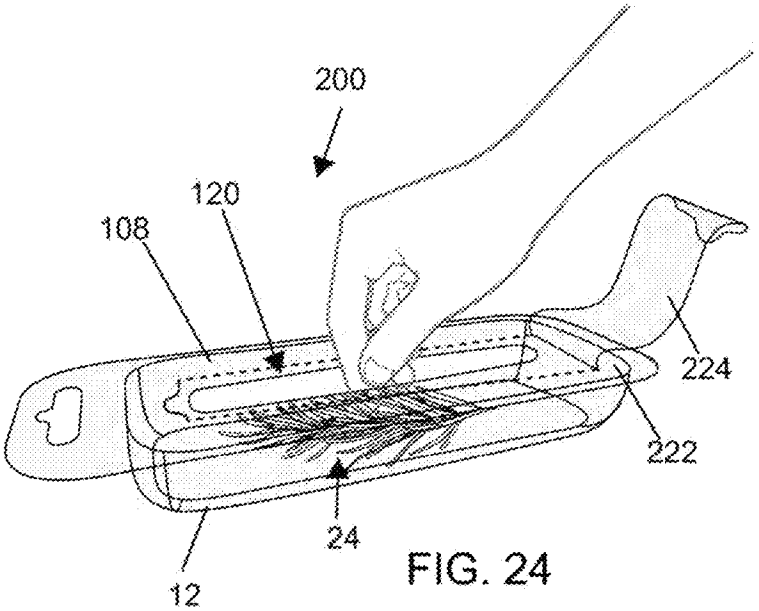
FIG. 24 is a perspective view of an individual grasping a food product (e.g., herbs) through the opening in the first layer of material after the second layer of material was peeled away from the first layer of material to allow access to the opening and in turn the food product arranged in the packaging apparatus of FIG. 18 according to an embodiment of the present disclosure.
Figure 25:
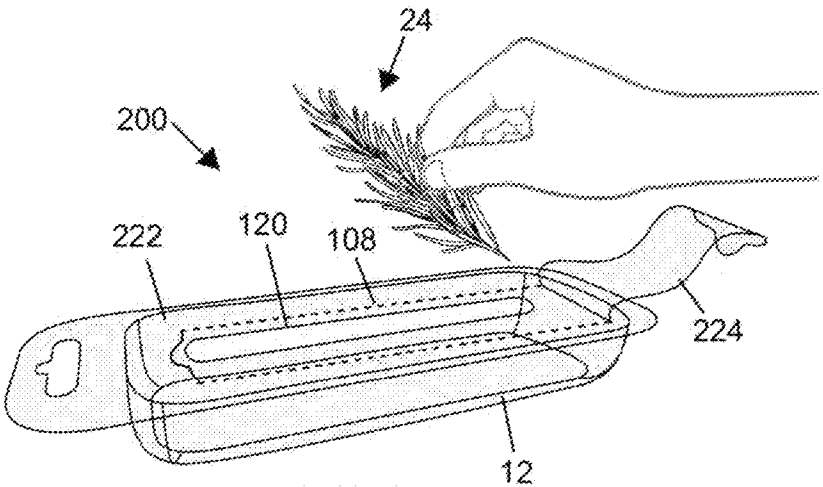
FIG. 25 is a perspective view of an individual removing the food product from the container apparatus of FIG. 18 through the opening in the first layer of material after the second layer of material is peeled away from the first layer of material to allow access to the opening and in turn the food product arranged in the packaging apparatus according to an embodiment of the present disclosure.
Figure 18:
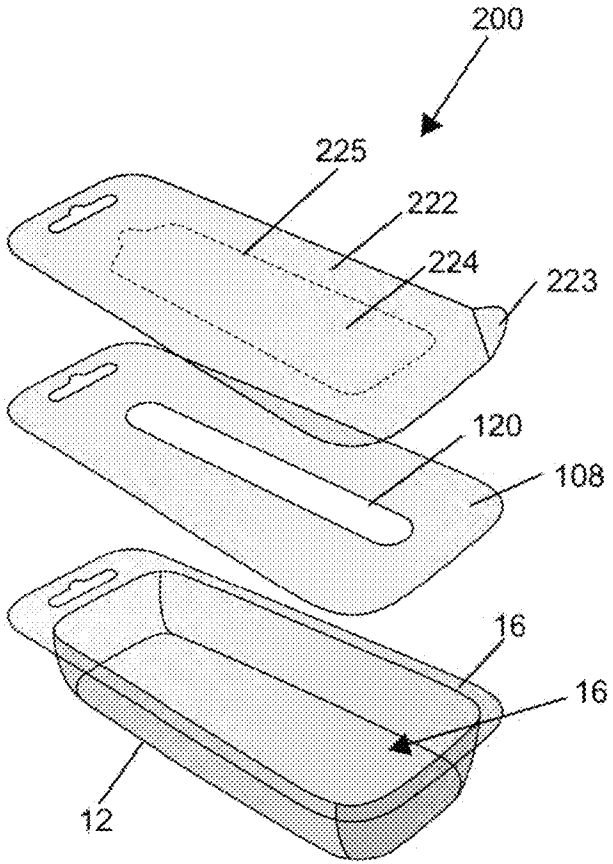
FIG. 18 is a perspective assembly view of a packaging apparatus that includes a resealable top layer that has a resealable panel or door according to another embodiment of the present disclosure.

As shown in FIG. 13, by adhering the first layer of material 108 to the container base 14 prior to filling the container base 14, the filling/packing of foods products 24 (e.g., live or fresh cut plants or leafy greens such as herbs) within the container base 12 is fully contained therein and the food product 24 does not extend or hang out of the packaging 100. That is, by adhering the first layer 108 to the container base 12 prior to packing the container base 12 with a food product 24, the possibility of the food product 24 extending out of the container base 12, becoming trapped between the sealing layer or second layer of material 22 of the container apparatus 100 and the base 12 and/or prohibiting a proper seal between the container base 12 and the sealing layer 22 is eliminated.

Figure 14:
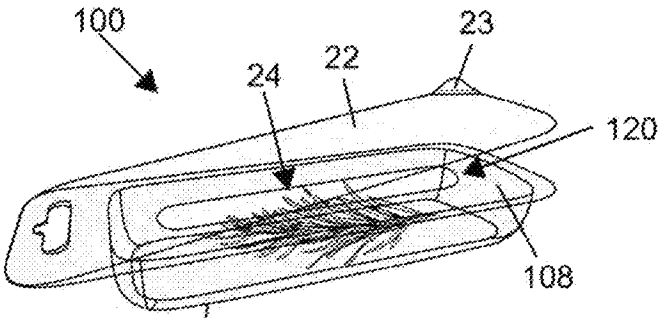
FIG. 14 is a perspective view of a second layer of material being placed over the first layer of material of the packaging apparatus of FIG. 10 according to an embodiment of the present disclosure.
Figure 15:
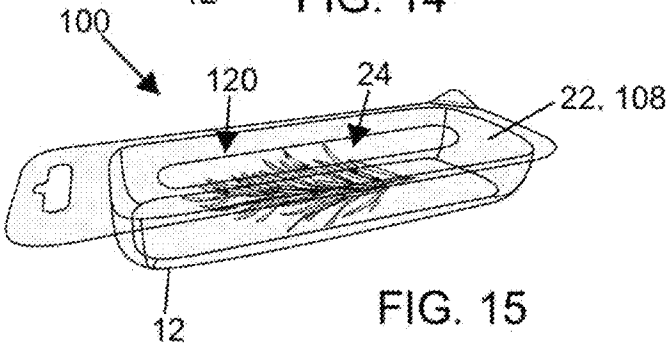
FIG. 15 is a perspective view of the second layer of material releasably fixed over the first layer of material to seal the packaging apparatus of FIG. 10 according to an embodiment of the present disclosure.

After the packaging 100 is filled/packed with the food product, as illustrated in FIGS. 14-15, the second layer of material 22 is arranged over the first layer of material 108 and adhered to the outer periphery of the first layer of material 108 and indirectly to the flange or rim 16 of the container base 12 to completely seal the packaging apparatus 100 and food product 24 therein.

The layers of material 108, 22 can be adhered to the container base 12 and/or each other by heat sealing or an adhesive with the second layer 22 configured to be a tamper evident seal to protect the product inside from contamination.

Figure 16:
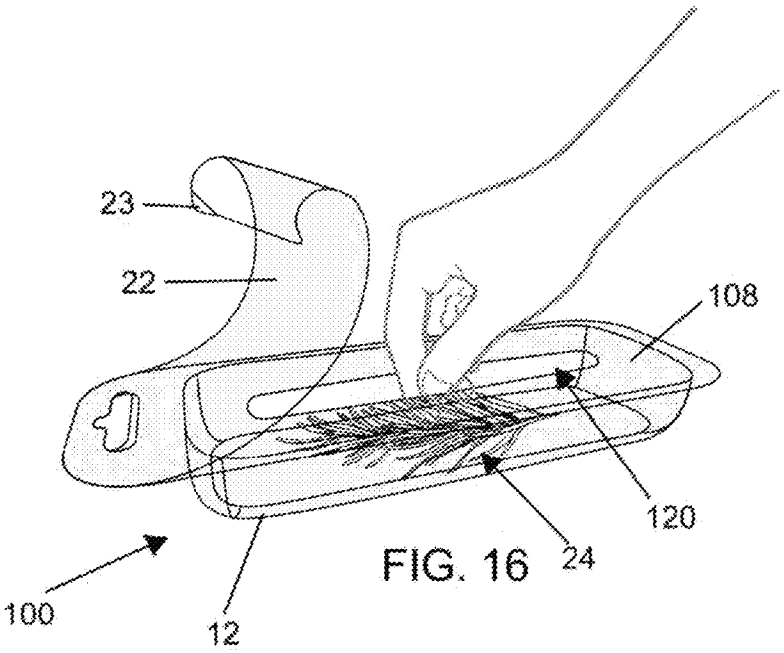
FIG. 16 is a perspective view of an individual grasping a food product (e.g., herbs) through the opening in the first layer of material after the second layer of material was peeled away from the first layer of material to allow access to the opening and in turn the food product arranged in the packaging apparatus of FIG. 10 according to an embodiment of the present disclosure.
Figure 17:
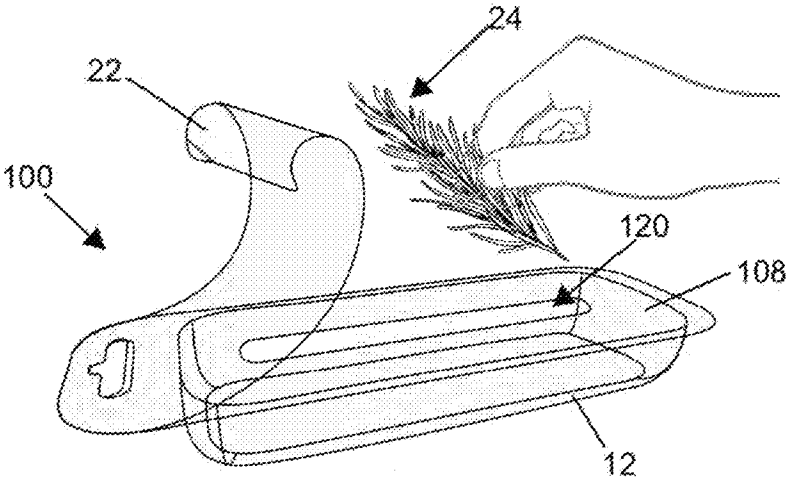
FIG. 17 is a perspective view of an individual removing the food product from the container apparatus of FIG. 10 through the opening in the first layer of material after the second layer of material is peeled away from the first layer of material to allow access to the opening and in turn the food product arranged in the packaging apparatus according to an embodiment of the present disclosure.
Figure 10:
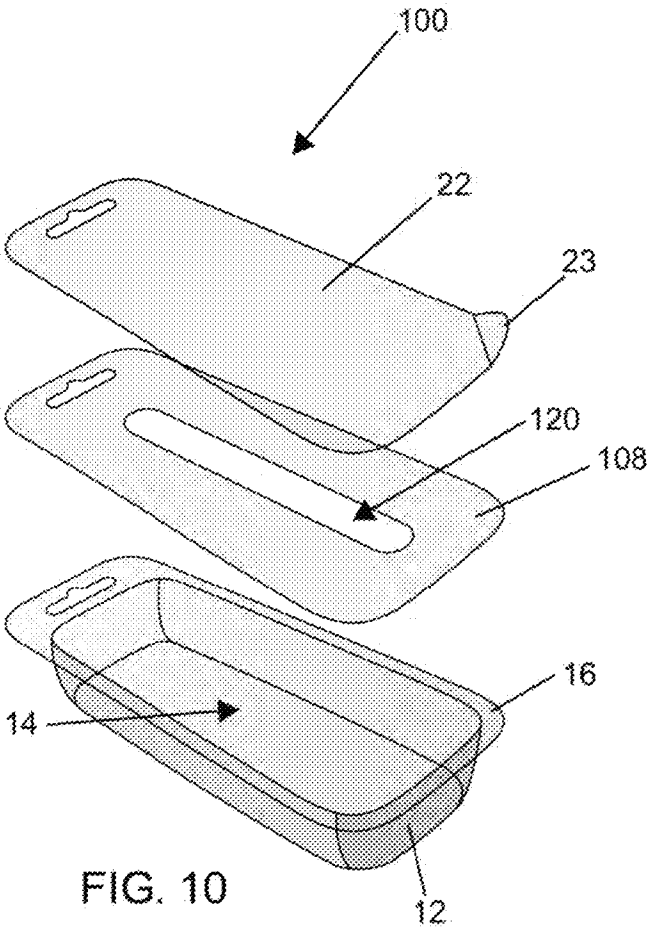
FIG. 10 is a perspective assembly view of a packaging apparatus according to another embodiment of the present disclosure.

Similar to the first layer of material 18 as depicted in FIGS. 1-9, here, the first layer of material 108 can also further aid to retain a moisture level in the packaging 100 so that the food product will not lose water and become dehydrated, for example, in the case of a leafy vegetable that is stored, for example, in a refrigerator should the second layer 22 be removed or not resealed properly to the first layer 108. Additionally, the first layer 108 and associated opening 120 aids to create a "portioning opening" through which an individual, as shown in FIGS. 16 and 17, can remove a desired amount of the food product from the packaging 100 without having to fully open the packaging 100 by removing a covering therefrom to remove the food product. An individual can remove the food product from the packaging 100 by peeling the second layer of material 22 back and reaching into the container base 12 through the opening 120 in the first layer of material 108.

Another embodiment of a packaging apparatus 200 is depicted in FIGS. 18-25. It is noted that like reference numerals as described above and illustrated in FIGS. 1-17 will be used in conjunction with this embodiment, where applicable.

As shown in FIGS. 18-25, the packaging apparatus 200 includes the container base or tray 12, a first layer of material 108 that includes an opening 120 and the second layer of material 224. The second layer of material 224 is tamper evident includes a perforated portion, door or panel 225 that allows for the panel or portion 225 to be at least partially removable from the first layer of material 108 to create an opening and resealable to the first layer 108 of material. While the perforated portion, door panel 225 is shown in association with a first layer of material 108 that has an ovoid opening, it is noted that the second layer of material 224 with the perforated portion or panel 225 can be arranged over a first layer of material having an opening of any shape or size and as such should not be limited to be in conjunction with the first layer of material 108 shown in FIGS. 18-25.

The first layer of material 108 and the second layer of material 224 can each be a thin layer of clear plastic film. Alternatively, the first and/or the second layer of material 108, 224, can be opaque or the like.

The opening 120 of the first layer of material 108 is depicted in FIGS. 17-25 as being ovoid. However, as noted above, the opening 120 can be of any shape desired. The opening 120 can be formed before or after the first layer of material 108 is fixed to the container base 12. For example, the opening 120 formed in the first layer of material 108 can be created by die cutting.

Figure 19:
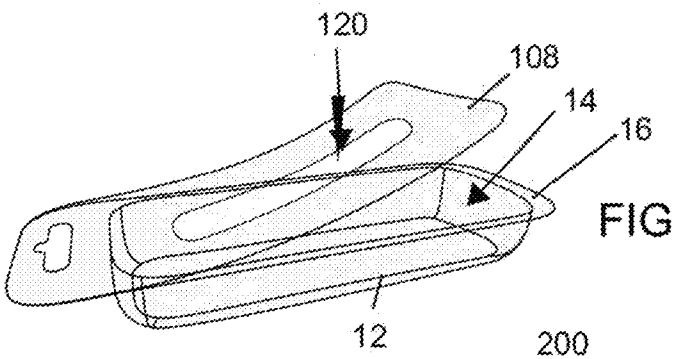
FIG. 19 is a perspective view of a first layer of material that includes an opening that extends therethrough being arranged over a container base of the packaging apparatus of FIG. 18 according to an embodiment of the present disclosure.
Figure 20:
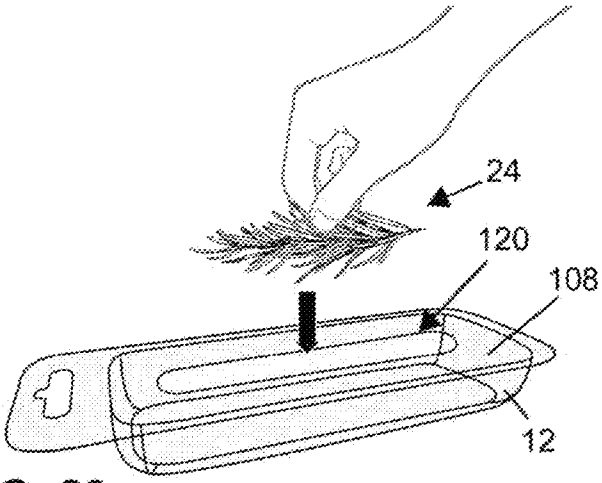
FIG. 20 is a perspective view of herbs being added through the opening in the first layer of material the packaging apparatus of FIG. 18 according to an embodiment of the present disclosure.

As can be seen in FIG. 19, the first layer of material 108 can be adhered, for example, to the rim or flange 16 of the container base 12. The container base 12, as depicted in FIG. 20, can then be filled with a food product 24, such as leafy greens, through the opening 108 in the first layer of material 108.

Figure 21:
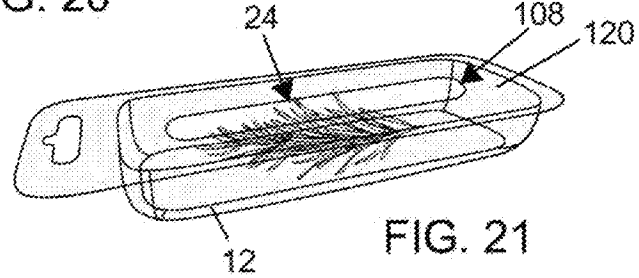
FIG. 21 is a perspective view of the placement of the herbs in the tray of the packaging apparatus of FIG. 18 according to an embodiment of the present disclosure.

As shown in FIG. 21, by adhering the first layer of material 108 to the container base 14 prior to filling the container base 14, the filling/packing of foods products 24 (e.g., live or fresh cut plants or leafy greens such as herbs) within the container base 12 is fully contained therein and the food product 24 does not extend or hang out of the packaging 200. That is, by adhering the first layer 108 to the container base 12 prior to packing the container base 12 with a food product 24, the possibility of the food product 24 extending out of the container base 12, becoming trapped between the sealing layer or second layer of material 22 of the container apparatus 200 and the base 12 and/or prohibiting a proper seal between the container base 12 and the sealing layer 22 is eliminated.

Figure 22:
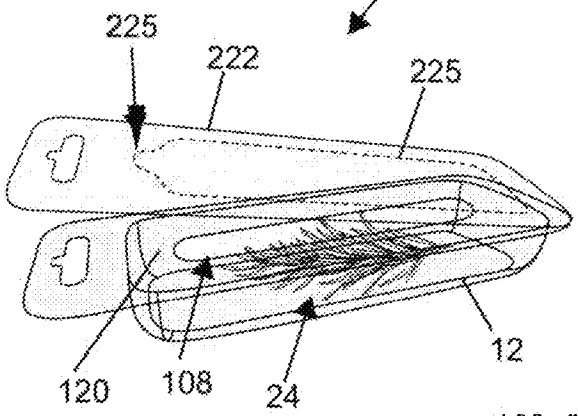
FIG. 22 is a perspective view of a second layer of material being placed over the first layer of material of the packaging apparatus of FIG. 18 according to an embodiment of the present disclosure.
Figure 23:
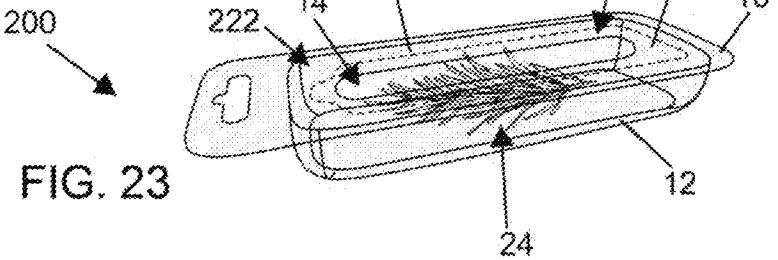
FIG. 23 is a perspective view of the second layer of material releasably fixed over the first layer of material to seal the packaging apparatus of FIG. 18 according to an embodiment of the present disclosure.

After the packaging 200 is filled/packed with the food product, as illustrated in FIGS. 22-23, the second layer of material 224 is arranged over the first layer of material 108 and adhered to the outer periphery of the first layer of material 108 and indirectly to the flange or rim 16 of the container base 12 to completely seal the packaging apparatus 200 and food product 24 therein.

The layers of material 108, 224 can be adhered to the container base 12 and/or each other by heat sealing or an adhesive with the second layer 224 configured to be a tamper evident seal to protect the product inside from contamination.

Similar to the first layer of material 18 as depicted in FIGS. 1-9, here, the first layer of material 108 can also further aid to retain a moisture level in the packaging 100 so that the food product will not lose water and become dehydrated, for example, in the case of a leafy vegetable that is stored, for example, in a refrigerator should the second layer 224 be removed or not resealed properly to the first layer 108. Additionally, the first layer 108 and associated opening 120 aids to create a "portioning opening" through which an individual, as shown in FIGS. 16 and 17, can remove a desired amount of the food product from the packaging 200 without having to fully open the packaging 200 by removing a covering therefrom to remove the food product. An individual can remove the food product from the packaging 200 by peeling the second layer of material 224 back and reaching into the container base 12 through the opening 120 in the first layer of material 108.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claimed is:

1. A packaging, comprising:

a container base including a bottom wall, a sidewall extending at a first end thereof from the bottom wall to define depth within the container base and a cavity therein and a flange extending from a second end of the sidewall outwardly from the sidewall, the sidewall including a first wall that extends longitudinally along the base, a second wall that is spaced from the first wall that extends longitudinally along the base, a third wall that extends from the base transverse between the first wall and the second wall and a fourth wall that is spaced from the third wall and extends transverse between the first wall and the second wall, the first wall and the second wall have a length that is greater than the third wall and the fourth wall;

a first layer of material having a single slit or a single open space extending therethrough, the first layer of material extending to an outer periphery of the flange in all directions and being fixed to the flange of the container base, the slit or open space extending linearly, longitudinally in the center of the first layer of material and being spaced from the flange such that the first layer of material extends substantially over the cavity of the container base toward the slit or open space therein and the slit or open space extends along the first wall and the second wall; and a second layer of material that is configured extend to an outer periphery of the flange and to be arranged over and at least in part releasably fixed to the first layer of material, the second layer of material being a same size as the first layer of material such that the first layer of material and the second layer of material extending a same distance in all directions.

2. The packaging of claim 1, wherein the first layer of material and the second layer of material are each a layer of plastic film.

3. The packaging of claim 1, wherein the first layer of material and the second layer of material are each transparent.

4. The packaging of claim 1, wherein the first layer of material is fixed to the container base by at least one of an adhesive and heating.

5. The packaging of claim 1, wherein the second layer of material includes a perforated panel.

6. The packaging of claim 1, wherein the packaging includes the container base and at most two layers of material arranged over the container base, said two layers of material being the first layer of material and the second layer of material.

7. A method of creating a packaging and packaging food, the method comprising the following steps:

forming a container base including a bottom wall, a sidewall extending from a first end thereof from the bottom wall to define depth within the container base and a cavity therein and a flange extending from a second end of the sidewall outwardly from the sidewall, the sidewall includes a first wall that extends longitudinally from the base, a second wall that is spaced from the first wall that extends longitudinally from the base, a third wall that extends from the base transverse between the first wall and the second wall and a fourth wall that is spaced from the third wall and extends transverse between the first wall and the second wall, the first wall and the second wall have a length that is greater than the third wall and the fourth wall;

arranging a first layer of material the container base, the first layer of material having a single slit or a single open space extending therethrough, the slit or open space extending linearly longitudinally in the center of the first layer of material and being spaced from the flange such that the first layer of material extends substantially over the cavity of the container base toward the slit or open space therein and the opening extends along the first wall and the second wall;

fixing the first layer of material to the container base with the first layer of material extending to an outer periphery of the flange in all directions;

inserting a food product through the slit or open space in the first layer of material subsequent to the first layer of material being fixed to the container base and arranging the food product within the container base; and arranging a second layer of material over the container base and the first layer of material subsequent to the food product being arranged within the container base, and, at least in part, releasably fixing the second layer of material to the first layer of material, the second layer of material being configured extend to an outer periphery of the flange and be a same size as the first layer of material such that the first layer of material and the second layer of material extending a same distance in all directions.

8. The method of claim 7, wherein the first layer of material and the second layer of material are each a layer of plastic film.

9. The method of claim 7, wherein the first layer of material and the second layer of material are each transparent.

10. The method of claim 7, wherein the first layer of material is fixed to the flange of the container base by at least one of an adhesive and heat sealing.

11. The method of claim 7, wherein the second layer of material includes a perforated portion thereof that is releasably removable from and resealable to the container apparatus.

12. The method of claim 7, wherein the slit or open space in the first layer of material is formed one of before the first layer is fixed to the container base or after the first layer is fixed to the container base.

* * * * *